United States Patent [19]

Smith

[11] Patent Number: 4,595,395

[45] Date of Patent: Jun. 17, 1986

[54] LUBRICATING AND ADDITIVE MIXTURES FOR ALCOHOL FUELS AND THEIR METHOD OF PREPARATION

[76] Inventor: Earl J. Smith, 2310 Cherry Ridge La., Brandon, Fla. 33511

[21] Appl. No.: 665,094

[22] Filed: Oct. 29, 1984

Related U.S. Application Data

[63] Continuation of Ser. No. 375,762, May 6, 1982, abandoned.

[51] Int. Cl.[4] ..... C10L 1/32

[52] U.S. Cl. ..... 44/51; 44/53; 44/56; 44/58; 44/62

[58] Field of Search ..... 44/53, 51, 58, 62, 56; 123/1 A

[56] References Cited

U.S. PATENT DOCUMENTS

| | | | |
|---|---|---|---|
| 1,420,007 | 6/1922 | Whitaker | 44/53 |
| 2,404,094 | 7/1946 | Robertson | 44/53 |
| 2,574,528 | 11/1951 | Brewer | 44/53 |
| 2,603,557 | 7/1952 | Roush | 44/51 |
| 3,048,479 | 8/1962 | Ilnyckyj et al. | 44/62 |
| 3,753,905 | 8/1973 | Souillard et al. | 44/51 |
| 4,231,756 | 11/1980 | King | 44/53 |
| 4,333,739 | 6/1982 | Neves | 44/53 |

*Primary Examiner*—Mrs. Y. Harris-Smith
*Assistant Examiner*—Margaret B. Medley
*Attorney, Agent, or Firm*—Duckworth, Allen, Dyer & Pettis

[57] ABSTRACT

A unique lubricating, corrosion inhibiting and rust inhibiting additive for alcohol fuels having from 1 to 5 carbon atoms is disclosed. The lubricating additive comprises a mixture consisting essentially of a lubricant, an emulsifying agent, ethylene-vinyl acetate copolymer and organic solvents formulated to obtain a mixture having a specific gravity substantially equivalent to that of the alcohol in which the lubricating additive will be mixed. The invention further comprises an alcohol fuel-lubricating additive mixture for use as a fuel in internal combustion engines as well as methods for preparing such mixtures.

28 Claims, No Drawings

LUBRICATING AND ADDITIVE MIXTURES FOR ALCOHOL FUELS AND THEIR METHOD OF PREPARATION

This application is a continuation of U.S. Ser. No. 375,762, filed 5/6/82, now abandoned.

BACKGROUND OF THE INVENTION

1. Field of the Invention

The present invention basically comprises a lubricating additive which may be added to alcohol fuels to result in a stable alcohol fuel-lubricating additive solution for use as a fuel in internal combustion engines. Also disclosed and claimed are methods for preparing such fuel mixtures.

2. Description of the Prior Art

During the past decade we have witnessed a marked, worldwide increase in research and development efforts toward developing new fuel sources as alternatives to petroleum-derived fuels such as, for example, gasoline and diesel-oil. Perhaps the most popular and widely accepted fuel alternative available today, particularly in the United States, comprises a mixture of 90 percent gasoline and 10 percent ethanol sold as a fuel for internal combustion engines under the generic name "gasohol." While universal acceptance of gasohol as a fuel mixture would obviously result in a ten percent decrease in relative gasoline consumption, almost all researchers and economists agree that gasohol fuel is, at best, a stopgap solution to the petroleum dependence of both industrialized and developing nations. In similar fashion, almost all researchers and economists agree that a more satisfactory solution to this problem would be the development of a fuel source containing only very minor amounts such as, for example, significantly less than 10 percent of petroleum-derived ingredients.

Alcohols have been identified as the alternative fuel source having the greatest potential for use in both spark ignited and compression ignited engines. However, actual testing of alcohols such as ethanol and methanol as alternative fuels has revealed a substantial problem resulting from their use. Because such alcohol fuel compositions are substantially devoid of any petroleum derived products, they are notably deficient in lubricating properties with the result that engine wear from the use of these alcohol fuels in internal combustion engines will normally result in unacceptable premature failure of the engines. Moreover, similar wear problems occur not only in the engine, but also in fuel delivery and injection systems. Briefly stated, then, the primary difficulty with using alcohol fuels resides in efficiently and economically enhancing the lubricating properties of such fuels. While this problem is widely recognized and, therefore, relatively easy to state. the development of a truly efficacious solution to the problem has proved to be particularly elusive. Useful lubricants simply are not normally soluble in alcohol, and despite many years of research lubricating additives capable of forming stable solutions with alcohol in an efficient, economical manner simply have not been developed.

One prior art attempt at solving this problem is disclosed in U.S. Pat. No. 1,591,665 to Esselen. This patent recognizes that lubricating oil is not miscible with alcohol, and proposes the use of an alkali salt of a higher fatty acid as an emulsifier medium for maintaining the lubricating oil in intimate mixture, or blend, with the alcohol. While a blend certainly can be obtained in accord with the teaching of this patent, actual laboratory testing has shown that the blend simply is not stable. Over a relatively short period of time the lubricant simply separates from the alcohol resulting in the virtual elimination of any significant lubricating characteristics. Furthermore, this patent also recognizes the normal desirability of including another constituent such as ether as a significant portion of the fuel. Actual testing of the fuel of this invention has further revealed that lubricating oils of relatively low viscosity must be utilized in order to obtain the initial emulsion, and, obviously, such low viscosity oils would have significantly reduced lubricating characteristics.

U.S. Pat. No. 2,404,091 to Robertson teaches the use of a motor fuel comprising about 80–98 percent methanol and a minor proportion of a hydrocarbon of 3–5 carbon atoms. Other ingredients ordinarily used in motor fuels such as anti-knock agents may also be incorporated into the motor fuel of this invention. However, there is no disclosure of means for increasing the lubricating characteristics of the fuel. U.S. Pat. No. 2,789,891 to Brandes, et al., discloses a fuel system conditioner intended to be added to gasoline fuels. The disclosure of this patent is deemed pertinent as part of the prior art for the reason that the conditioner consists essentially of a homogeneous mixture of a light lubricating oil, an aliphatic alcohol, an aliphatic ketone and an ester of an aliphatic acid. However, this patent does not teach an alcohol fuel, per se; it merely discloses an additive for gasoline fuels.

U.S. Pat. No. 3,018,479 to Ilnyckyj, U.S. Pat. No. 3,567,639 to Aaron, and U.S. Pat. No. 3,693,720 to McDougall all disclose the use of ethylene-vinyl acetate copolymer in hydrocarbon oils as a pour point depressant and for the purpose of inhibiting deposition of wax on surfaces with which the oil may come into contact. However, none of these patents suggest that this copolymer might be effective in obtaining alcohol-lubricating oil fuel mixtures having stable solution characteristics.

Further searching of the prior art reveals numerous anti-wear compression ignition fuels for use in diesel engines assigned to Ethyl Corporation. Illustrative of these are the following U.S. Pat. Nos.:

4,177,768
4,185,594
4,198,931
4,204,481
4,208,190
4,242,099
4,248,182.

Unfortunately, as a review of this patent literature will confirm, there still is virtually no teaching of a lubricating additive mixture for alcohol fuels and fuel-additive mixtures suitable for use in spark ignited internal combustion engines which possesses sufficient lubricating properties to insure efficient operation of the engine.

Accordingly, it is clear that there is a great need in the art for lubricating additive mixtures suitable for use with alcohol fuels for the operation of internal combustion engines. It is to be understood that any such additive mixture must be capable of economic production. Perhaps even more importantly, however, the resulting fuel-additive mixture must comprise a stable solution for purposes of storage, transportation and ultimate end use.

SUMMARY OF THE INVENTION

A primary purpose of the present invention is to provide a lubricating additive for use in combination with alcohol fuels for internal combustion engines whereby significant lubricating characteristics are provided for protection of the internal components of the engine and its fuel delivery and injection systems. In a preferred embodiment the present invention comprises a lubricating additive formulated by the mixture of a petroleum base stock lubricant, an emulsifier, ethylene-vinyl acetate copolymer, and organic solvents. As will be set forth in greater detail hereinafter, the organic solvents comprise a mixture of aliphatic solvents and aromatic solvents.

More specifically, the lubricant may be selected from the class consisting of paraffinic hydrocarbons, napthenic hydrocarbons, alkylated aromatics, polyalphaolefins, polybutenes, dibasic acid esters, polyol esters, polyesters, halogenated hydrocarbons, phosphate esters, polyglycols, polyphenyl esters, silicate esters, and silicones. The preferred lubricant is 120 SUS (Saybolt Universal Seconds) paraffinic bright stock derived from a paraffinic petroleum crude oil. While the emulsifier may be selected from virtually any of the commercially available emulsifiers commonly used to manufacture soluble oils, potassium carboxylate emulsifiers appear to work best. The solvents may be selected from the class consisting of mineral spirits, naptha, cyclohexane, hexane, heptane, pentane, isopentane, toluene, xylene, and benzene. The ethylene-vinyl acetate copolymer utilized in the preferred embodiment is commercially available under the brand name Paradyne 25.

While specific examples setting forth various formulations for the lubricating additive of this invention will be presented hereinafter, it should be noted that the organic solvent constituents are selected and mixed in a proportion that will yield a specific gravity substantially equivalent to that of the alcohol fuel to which the lubricating additive is mixed. Accordingly, a preferred formulation for providing lubricity in 180–200 proof ethanol comprises, by volume, about 94.6% solvent, about 1.25% emulsifier, about 3.75% lubricant, and about 0.4% ethylene-vinyl acetate copolymer. This lubricating additive is mixed with the 180–200 proof ethanol at about 4%, by volume, lubricating additive In similar fashion a preferred formulation for methanol consists, by volume, of about 95.6% solvent, about 1.0% emulsifier, about 3.0% lubricant, and about 0.4% ethylene-vinyl acetate copolymer. This lubricating additive is mixed to the methanol at about 5% additive, by volume.

While conventional blending and mixing techniques may be used in preparing the various lubricating additives of this invention, some degree of care must be exercised in mixing the additive with the alcohol fuel in order to obtain a stable alcohol fuel-lubricating additive mixture as the final product. When preparing a fuel mixture comprising ethanol and additive, the preferred formulation for the lubricating additive is added slowly to the top of the alcohol in its container. Agitation is not necessary, and an emulsion initially forms. Within about 48 hours this emulsion becomes a stable solution. When preparing methanol-additive fuel mixtures the preferred additive for methanol is added to the methanol with agitation. As above, an emulsion initially forms. This emulsion becomes a solution after about 48 hours. A portion of the lubricant will not go into solution but will settle at the bottom of the container. The methanol-lubricating additive mixture must be decanted from the excess lubricant to obtain the final fuel-additive mixture.

Actual laboratory testing to determine the lubricating characteristics of fuel-additive mixtures prepared in accord with this invention have been conducted and clearly demonstrate the efficacy of the invention. Procedures and results of these tests are set forth hereinafter.

The invention accordingly comprises the composition possessing the features, properties, and the relation of components which are exemplified in the following detailed disclosure, and the several steps in the relation of one or more of such steps with respect to each of the others, and the scope of the invention will be indicated in the claims.

DETAILED DESCRIPTION

The present invention relates to unique lubricating, corrosion inhibiting and rust inhibiting additives for alcohol fuels in compression ignited and spark ignited internal combustion engines. The lubricating additive of this invention is suitable for use in combination with monohydroxy alcohol fuels having from 1–5 carbon atoms and the scope of the invention includes not only the additive, but also alcohol fuel-lubricating additive mixtures and their method of preparation. Broadly stated, the lubricating additive of this invention consists essentially of, by volume, about 94–96% organic solvent, about 0.2–1.5% emulsifier, about 3–4% lubricant, and about 0.3–0.5% ethylene-vinyl acetate copolymer. For end use as a fuel, the lubricating additive is mixed with alcohol at about 3–6%, by volume, of the alcohol fuel-lubricating additive mixture.

The organic solvent constituent of the lubricating additive normally comprises a mixture of aliphatic solvents and aromatic solvents. The solvents may be selected from the class consisting of mineral spirits, naptha, cyclohexane, hexane, heptane, pentane, isopentane, toluene, xylene, and benzene. The lubricant component of the lubricating additive may be a petroleum base stock consisting of paraffinic, napthenic or mixed base hydrocarbons, or it may be a synthetic base stock consisting of alkylated aromatics, polyalphaolefins, polybutenes, dibasic acid esters, polyol esters, polyesters, halogenated hydrocarbons, phosphate esters, polyglycols, polyphenyl esters, silicate esters, or silicones. The emulsifier may consist essentially of any of the commercially available emulsifiers commonly used to manufacture soluble oils, with the emulsifier comprising potassium carboxylate being preferred. Emulsifiers containing sodium sulfonate are also effective, but will result in slight sodium precipitate.

The following examples, then, are set forth in order to describe more fully the composition and method of the present invention. In the following examples all component quantities are expressed as percent, by volume.

EXAMPLE I

A lubricating additive intended for use in combination with 180–200 proof ethanol as a fuel mixture was prepared by mixing together the following components:

| | |
|---|---|
| Toluene | 64.6% |
| Mineral Spirits | 30.0% |

-continued

| | |
|---|---|
| Emulsifier comprising Potassium Carboxylate | 1.25% |
| Paraffinic bright stock 120 SUS | 3.75% |
| Ethylene-vinyl acetate copolymer | 0.4% |

The resulting lubricating additive had a specific gravity of about 0.796 g/ml at 20° C., which is substantially equivalent to the specific gravity of 190 proof ethanol.

EXAMPLE II

The lubricating additive of Example I was added to 180–200 proof ethanol at the rate of about one gallon additive per 25 gallons ethanol about 4% additive and 96% ethanol). Initially, an emulsion formed. This emulsion was allowed to sit, and within about 48 hours a stable ethanol-lubricating additive solution suitable for use as a fuel for internal combustion engines resulted.

EXAMPLE III

A lubricating additive intended for use in combination with 180–200 proof ethanol as a fuel mixture was prepared by mixing together the following components:

| | |
|---|---|
| Xylene | 65.% |
| Mineral Spirits | 30.% |
| Emulsifier comprising Potassium Carboxylate | 1.25% |
| Paraffinic bright stock 120 SUS | 3.75% |
| Ethylene-vinyl acetate copolymer | 0.4% |

EXAMPLE IV

The lubricating additive of Example III was added to 180–200 proof ethanol in accord with the method of Example II with substantially identical results.

EXAMPLE V

A lubricating additive intended for use in combination with 180–200 proof ethanol as a fuel mixture was prepared by mixing together the following components:

| | |
|---|---|
| Benzene | 60.% |
| Mineral Spirits | 35.% |
| Emulsifier comprising Potassium carboxylate | 1.25% |
| Paraffinic bright stock 120 SUS | 3.75% |
| Ethylene-vinyl acetate copolymer | 0.4%. |

EXAMPLE VI

The lubricating additive of Example V was added to 180–200 proof ethanol in accord with the method of Example II with substantially identical results.

EXAMPLE VII

A lubricating additive intended for use in combination with methanol as a fuel mixture was prepared by mixing together the following components:

| | |
|---|---|
| Toluene | 23.% |
| Mineral Spirits | 72.6% |
| Emulsifier comprising Potassium carboxylate | 1.% |
| Paraffinic bright stock 120 SUS | 3.% |
| Ethylene-vinyl acetate copolymer | 0.4%. |

The resulting lubricating additive had a specific gravity of about 0.792 g/ml at 20° C., which is substantially equivalent to the specific gravity of methanol.

EXAMPLE VIII

The lubricating additive of Example VII was admixed to methanol at a ratio of about 5% additive to aout 95% methanol. Initially, an emulsion formed. After being allowed to sit for about 24 hours the emulsion was observed to contain a lubricant residue at the bottom of the container. The methanol-lubricating additive emulsion was decanted from the lubricant residue and allowed to sit further. After about 48 hours a stable methanol-lubricating additive solution suitable for use as a fuel for internal combustion engines resulted. Further observation of sample portions of this solution did reveal that separation of the methanol and the lubricating additive will occur if the water content of the methanol becomes too high.

EXAMPLE IX

A lubricating additive intended for use in combination with 180–200 proof ethanol as a fuel mixture was prepared by mixing together the following components:

| | |
|---|---|
| Toluene | 62.% |
| Stoddard solvent | 28.% |
| Emulsifier comprising Potassium carboxylate | 2.5% |
| Paraffinic bright stock 120 SUS | 7.5% |
| Ethylene-vinyl acetate copolymer | 0.4%. |

EXAMPLE X

The lubricating additive of Example IX was added to 190 proof ethanol in accord with the method of Example II and resulted in a stable ethanol-lubricating additive solution having only very minor amounts of lubricant residue after 24 hours.

EXAMPLE XI

A lubricating additive intended for use in combination with methanol as a fuel mixture was prepared by mixing together the following components:

| | |
|---|---|
| Toluene | 63.% |
| Isopentane | 33.3% |
| Emulsifier comprising Potassium carboxylate | 0.825% |
| Paraffinic bright stock 120 SUS | 2.475% |
| Ethylene-vinyl acetate copolymer | 0.4%. |

EXAMPLE XII

The lubricating additive of Example XI was added to methanol containing about 3% isopentane in accord with the method of Example VIII with the exception that about 6% additive was admixed to about 94% methanol-isopentane solution resulting in a final methanol content of about 91%. The final result of this example was equivalent to that obtained in Example VIII.

EXAMPLE XIII

A lubricating additive intended for use in combination with methanol as a fuel mixture was prepared by mixing together the following components:

| | |
|---|---|
| Toluene | 64.% |
| Isopentane | 33.6% |
| Emulsifier comprising Potassium carboxylate | .5% |
| Paraffinic bright stock 120 SUS | 1.5% |
| Ethylene-vinyl acetate copolymer | 0.4%. |

EXAMPLE XIV

The lubricating additive of Example XII was added to methanol containing about 3% isopentane in accord with the method of Example XII with substantially identical results.

EXAMPLE XV

A lubricating additive intended for use in combination with methanol as a fuel mixture was prepared by mixing together the following components:

| | |
|---|---|
| Toluene | 63.6% |
| Isopentane | 33.3% |
| Emulsifier comprising Potassium carboxylate | 0.675% |
| Paraffinic bright stock 120 SUS | 2.025% |
| Ethylene-vinyl acetate copolymer | 0.4%. |

EXAMPLE XVI

The lubricating additive of Example XV was added to methanol containing about 3% isopentane in accord with the method of Example XII with substantially identical results.

EXAMPLE XVII

A lubricating additive concentrate intended for use in preparing lubricating additives for alcohol fuels or for use as a lubricating additive in gasoline-alcohol and diesel fuel-alcohol mixtures was prepared by mixing together the following components:

| | |
|---|---|
| Mineral spirits | 64.9% |
| Emulsifier comprising Potassium carboxylate | 8.125% |
| Paraffinic bright stock 120 SUS | 24.375% |
| Ethylene-vinyl acetate copolymer | 2.6%. |

The result was a stable solution having a shelf life of several months.

EXAMPLE XVIII

The lubricating concentrate of Example XVII was mixed with appropriate quantities of aliphatic and aromatic solvents to yield various lubricating additives as set forth in Examples I, III, V and VII. These additives were then mixed with alcohols in accord with the methods of Examples II and VIII with substantially identical results.

EXAMPLE XIX

The lubricating concentrate of Example XVII was added to gasohol at a ratio of about 0.6% concentrate to about 99.4% gasohol for the purposes of reducing acid blowby in the engine, reducing rust corrosion and wear in fuel delivery systems and in thee upper cylinder area of the engine reducing fuel consumption by improving engine sealing and increasing engine compression, and perhaps most importantly inhibiting the phase separation tendancies of gasohol and other petroleum-alcohol fuel mixtures.

EXAMPLE XX

A modified Timpken test was conducted for the purpose of comparing the lubricity of the methanol-lubricating additive fuel mixture of Example VIII with the lubricity of #2 diesel fuel. At the conclusion of the test measurement of scars on the steel balls confirmed that the lubricity of the mixture of Example VIII was from about 7% to about 17% to greater than that of the #2 diesel fuel.

Additional testing of the alcohol-lubricating additive mixtures of this invention is being conducted for the purpose of obtaining further quantitiative and qualitative data as to the anti-wear, corrosion inhibiting and rust inhibiting properties of such mixtures when compared with currently available fuels and fuel mixtures. Preliminary results substantiate the significantly enhanced characteristics of the compositions included within the scope of this invention. The lubricating additive of this invention has also been comparatively tested with other additives such as those disclosed in the prior patent literature, and preliminary results of that testing further confirms the enhanced anti-wear, corrosion inhibiting and rust inhibiting characteristics of the compositions of this invention.

Two further general statements should be noted with regard to this invention. First, while the preferred emulsifier comprises potassium carboxylate, it also includes a rust inhibitor of an amine type pluus minor amounts of other materials such as, for example, fungicides. In similar fashion, lubricants including known additives for enhancing lubricating characteristics are compatible with the composition and method of this invention. Such lubricant materials are commonly referred to in the art as fully formulated lubricants.

In summary, then, and with particular reference to the examples given in the above detailed description, it can be seen that the lubricating additive of this invention is especially efficacious for the purpose of imparting desirable characteristics to alcohol fuels of 1–5 carbon atoms. Alcohol-lubricating additive fuel mixtures prepared in accord with the method of this invention are furthermore unique in that they maintain the physical characteristic of a stable solution for extremely long periods of time.

It will thus be seen that the objects set forth above, among those made apparent from the preceeding description, are efficiently attained, and since certain changes may be made in carrying out the above method and the compositions set forth without departing from the scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A lubricating additive for alcohol fuels, said additive consisting essentially of about 94–96%, by volume, organic solvent selected from the class consisting of mineral spirits, toluene, xylene, benzene, naphtha, cyclohexane, hexane, heptane, pentane, isopentane, and mixtures thereof; about 0.2–1.5%, by volume, emulsifier; at least about 3–4%, by volume, lubricant; and about 0.3–0.5, by volume, ethylene-vinyl acetate copolymer, wherein said additive is mixed with an alcohol fuel at about 4–6%, by volume, of the fuel-additive mixture.

2. A lubricating additive as in claim 1 wherein said organic solvent consists essentially of mineral spirits and toluene.

3. A lubricating additive as in claim 1 wherein said organic solvent consists essentially of mineral spirits and xylene.

4. A lubricating additive as in claim 1 wherein said organic solvent consists essentially of mineral spirits and benzene

5. A lubricating additive as in claim 1 wherein said lubricant is selected from the class consisting of paraffinic hydrocarbons, napthenic hydrocarbons, alkylated aromatics, polyalphaolefins, polybutenes, dibasic acid esters, polyol esters, polyesters, halogenated hydrocarbons, phosphate esters, polyglycols, polyphenyl esters, silicate esters, and silicones.

6. A lubricating additive as in claim 5 wherein said lubricant consists essentially of paraffinic bright stock.

7. A lubricating additive as in claim 5 wherein said lubricant consists essentially of 150 SUS paraffinic solvent bright stock plus an effective amount of solvent refined paraffinic neutral to obtain a final viscosity of about 120 SUS.

8. A lubricating additive as in claim 1 wherein said alcohol fuel is selected from the class consisting of monohydroxy alcohols having from 1–5 carbon atoms.

9. A lubricating additive as in claim 8 wherein said alcohol fuel is selected from the class consisting of ethanol and methanol.

10. A lubricating additive as in claim 9 wherein said alcohol fuel consists essentially of 180–200 proof ethanol.

11. A lubricating additive as in claim 9 wherein said alcohol fuel consists essentially of methanol.

12. An alcohol fuel-lubricating additive mixture for use as a fuel in internal combustion engines, said fuel-additive mixture consisting essentially of about 94–96%, by volume, alcohol and about 4–6%, by volume additive, wherein said additive consists essentially of: a. about 94–96%, by volume, organic solvent selected from the class consisting of mineral spirits, toluene, xylene, benzene, naptha, cyclohexane, hexane, heptane, pentane, isopentane, and mixtures thereof; b. about 0.2–1.5%, by volume, emulsifier; c. about 3–4%, by volume, lubricant; and d. about 0.3–0.5%, by volume, ethylene-vinyl acetate copolymer.

13. An alcohol fuel-lubricating additive mixture as in claim 12 wherein said alcohol consists essentially of 180–200 proof ethanol, and wherein said additive consists essentially of about 94.6%, by volume, of said organic solvent, about 1.25%, by volume, of said emulsifier, about 3.75%, by volume, of said lubricant, and about 0.4%, by volume, of said copolymer.

14. An alcohol fuel-lubricating additive mixture as in claim 13 wherein said organic solvent consists essentially of a major proportion of toluene and a minor proportion of mineral spirits, and wherein said lubricant consists essentially of paraffinic bright stock.

15. An alcohol fuel-lubricating additive mixture as in claim 14 wherein said organic solvent consists essentially of about 64.6% toluene and about 30% mineral spirits, and wherein said lubricant has a viscosity of about 120 SUS.

16. An alcohol fuel-lubricating additive mixture as in claim 15 consisting essentially of about 96%, by volume, of said ethanol and about 4%, by volume, of said additive.

17. An alcohol fuel-lubricating additive mixture as in claim 13 wherein said organic solvent consists essentially of a major proportion of xylene and a minor proportion of mineral spirits, and wherein said lubricant consists essentially of paraffinic bright stock.

18. An alcohol fuel-lubricating additive mixture as in claim 17 wherein said organic solvent consists essentially of about 65% xylene and about 30% mineral spirits, and wherein said lubricant has a viscosity of about 120 SUS.

19. An alcohol fuel-lubricating additive mixture as in claim 13 wherein said organic solvent consists essentially of a major proportion of benzene and a minor proportion of mineral spirits, and wherein said lubricant consists essentially of paraffinic bright stock.

20. An alcohol fuel-lubricating additive mixture as in claim 19 wherein said organic solvent consists essentially of about 60% benzene and about 35% mineral spirits, and wherein said lubricant has a viscosity of about 120 SUS.

21. An alcohol fuel-lubricating additive mixture as in claim 12 wherein said alcohol consists essentially of methanol, and wherein said additive consists essentially of about 95.6%, by volume, of said organic solvent, about 1%, by volume, of said emulsifier, about 3%, by volume, of said lubricant, and about 0.4%, by volume, of said copolymer.

22. An alcohol fuel-lubricating additive mixture as in claim 21 wherein said organic solvent consists essentially of a major proportion of mineral spirits and a minor proportion of an aromatic solvent, and wherein said lubricant consists essentially of paraffinic bright stock.

23. An alcohol fuel-lubricating additive mixture as in claim 22 wherein said organic solvent consists essentially of about 73% mineral spirits and about 23% aromatic solvent, and wherein said lubricant has a viscosity of about 120 SUS.

24. An alcohol fuel-lubricating additive mixture as in claim 22 consisting essentially of about 95%, by volume, of said methanol and about 5%, by volume, of said additive.

25. A method for preparing an ethanol fuel-lubricating additive mixture for use as fuel in an internal combustion engine, said method comprising the steps of:

a. preparing said lubricating additive by mixing together about 94–96%, by volume, organic solvent selected from the class consisting of mineral spirits, toluene, xylene, benzene, naptha, cyclohexane, hexane, heptane, pentane, isopentane, and mixtures thereof, about 0.2–1.5%, by volume, emulsifier, about 3–4%, by volume, lubricant, and about 0.3–0.5%, by volume, ethylene-vinyl acetate copolymer; and b. adding said lubricating additive to 180–200 proof ethanol at a ratio of about 94–96%, by volume, ethanol and about 4–6%, by volume, additive to obtain the ethanol fuel-lubricating additive mixture as an emulsion.

26. A method as in claim 25 further comprising the step of agitating said ethanol as said additive is added thereto.

27. A method as in claim 25 further comprising the step of allowing the resulting mixture to sit for about 48 hours to obtain the ethanol fuel-lubricating additive mixture as a solution.

28. A method for preparing a methanol fuel-lubricating additive mixture for use as fuel in an internal combustion engine, said method comprising the steps of:

a. preparing said lubricating additive by mixing together about 94–96%, by volume, organic solvent selected from the class consisting of mineral spirits, toluene, xylene, benzene, naptha, cyclohexane, hexane, heptane, pentane, isopentane, and mixtures thereof, about 0.2–1.5%, by volume emulsifier, about 3–4%, by volume, lubricant, and about 0.3–0.5%, by volume, ethylene-vinyl acetate copolymer;

b. adding said lubricating additive to methanol with agitation at a ratio of about 94–96%, by volume, methanol and about 4–6%, by volume, additive to obtain a fuel-additive emulsion;

c. allowing the resulting emulsion to sit for at lease 24 hours to permit setting of non-emulsified lubricant;

d. decanting the fuel-additive emulsion from the non-emulsified lubricant; and e. allowing the decanted fuel-lubricating additive emulsion to sit for at least about 48 hours to obtain the methanol fuel-additive mixture as a solution.

* * * * *